US007757451B2

(12) United States Patent
Lee Lum

(10) Patent No.: US 7,757,451 B2
(45) Date of Patent: Jul. 20, 2010

(54) VENTILATED BUILDING BLOCK

(76) Inventor: Mark E. Lee Lum, No. 3 Irwin Avenue, La Seiva, Maraval (TT)

( * ) Notice: Subject to any disclaimer, the term of this patent is extended or adjusted under 35 U.S.C. 154(b) by 0 days.

(21) Appl. No.: 12/292,376

(22) Filed: Nov. 18, 2008

(65) Prior Publication Data

US 2010/0122507 A1 May 20, 2010

(51) Int. Cl.
*E04C 3/30* (2006.01)

(52) U.S. Cl. ..... 52/574; 52/302.4; 52/503; 52/606; 52/607

(58) Field of Classification Search ..... 52/574, 52/302.4, 604, 606, 607, 503–505, 608, 609
See application file for complete search history.

(56) References Cited

U.S. PATENT DOCUMENTS

| | | | | | |
|---|---|---|---|---|---|
| 274,357 | A | * | 3/1883 | McKenna | 165/9.1 |
| 1,374,955 | A | * | 4/1921 | Schenk | 52/608 |
| 1,394,406 | A | * | 10/1921 | Calvert | 52/302.4 |
| 1,649,780 | A | * | 11/1927 | Robbins | 52/609 |
| 1,758,757 | A | | 5/1930 | Niemann | |
| 1,862,246 | A | * | 6/1932 | Ticehurst | 52/608 |
| 1,968,680 | A | * | 7/1934 | Grothaus | 454/185 |
| 2,137,153 | A | | 11/1938 | Brozek | |
| 2,624,193 | A | * | 1/1953 | Larson | 52/503 |
| 2,634,118 | A | * | 4/1953 | Jantsch | 165/9.3 |
| 3,230,914 | A | * | 1/1966 | Mann | 110/335 |
| 4,269,537 | A | * | 5/1981 | O'Neill | 405/29 |
| D264,996 | S | * | 6/1982 | Siedschlag | D25/117 |
| 4,736,550 | A | * | 4/1988 | Hawranick | 52/574 |
| 4,823,530 | A | | 4/1989 | Haring | |
| 4,854,103 | A | | 8/1989 | Klym | |
| 5,159,801 | A | * | 11/1992 | Schmidt | 52/575 |
| 5,221,223 | A | * | 6/1993 | Kao | 446/85 |
| 5,282,700 | A | * | 2/1994 | Rodrique | 405/284 |
| 5,294,216 | A | * | 3/1994 | Sievert | 405/286 |
| 5,457,926 | A | | 10/1995 | Jensen | |
| 5,560,172 | A | * | 10/1996 | Brophy et al. | 52/596 |
| 5,687,531 | A | * | 11/1997 | Nelson et al. | 110/338 |
| 5,822,939 | A | * | 10/1998 | Haener | 52/405.2 |
| 5,826,394 | A | * | 10/1998 | Barton et al. | 52/592.1 |
| 5,826,395 | A | * | 10/1998 | Weaver | 52/606 |
| 5,873,206 | A | * | 2/1999 | Roberts | 52/245 |
| 5,881,511 | A | * | 3/1999 | Keller, Jr. | 52/220.2 |
| 6,108,995 | A | * | 8/2000 | Bouchard et al. | 52/609 |
| 6,568,143 | B2 | * | 5/2003 | Coleman | 52/604 |
| 6,874,293 | B2 | * | 4/2005 | Manthei | 52/596 |
| 7,011,474 | B2 | * | 3/2006 | MacDonald | 405/284 |
| 7,096,634 | B2 | | 8/2006 | Dean, Jr. | |

(Continued)

*Primary Examiner*—David Dunn
*Assistant Examiner*—Joshua Ihezie
(74) *Attorney, Agent, or Firm*—Nixon & Vanderhye, P.C.

(57) ABSTRACT

A building block for a ventilated wall includes an elongated center portion flanked by a pair of substantially parallel side walls oriented substantially perpendicularly to the center portion. The center portion has a first vertical wall and a second sloped wall, the second sloped wall extending between a relatively thicker bottom wall of the center portion and a relatively thinner top wall of the center portion. The first wall is co-planar with first edges of the side walls. A stacked arrangement of such blocks, where adjacent blocks are inverted and reversed, establishes front-to-back air passages that do not provide a sight line, and which prevent rain from passing through. A mold assembly for manufacturing the blocks is also disclosed.

7 Claims, 9 Drawing Sheets

U.S. PATENT DOCUMENTS

| | | | | |
|---|---|---|---|---|
| 7,152,381 | B2 * | 12/2006 | Hasley | 52/561 |
| 6,523,317 | B1 | 2/2008 | Bott | |
| 2001/0054268 | A1 * | 12/2001 | Coleman | 52/604 |
| 2004/0182038 | A1 * | 9/2004 | Manthei | 52/608 |
| 2005/0091940 | A1 * | 5/2005 | Whitson | 52/574 |

* cited by examiner

VENTILATED BUILDING BLOCK

This application relates to a building block construction, and more specifically, to a self-ventilating block with weather inhibiting and privacy enhancing features.

BACKGROUND OF THE INVENTION

Currently, typical concrete ventilating blocks are formed with straight, internal passages extending vertically through the block, such that when plural blocks are stacked, a ventilating "chimney" is formed. These and other block constructions are well represented in the patent literature. For example, U.S. Pat. No. 2,137,153 discloses ventilated wall blocks that are stacked vertically in an alternately inverted orientation, establishing both vertical and horizontal vent passageways. In U.S. Pat. No. 7,096,634, a block is disclosed that, when stacked, creates vertical vents or cores. Still other block constructions are disclosed in U.S. Pat. Nos. 1,758,757; 2,624,193; and 4,823,530. There remains a need, however, for a horizontally-vented block for use in wall constructions that allows horizontal air circulation through the wall, but that inhibits rain from passing through the wall and that also enhances the privacy of persons on the interior side of the wall.

BRIEF DESCRIPTION OF THE INVENTION

In accordance with an exemplary but nonlimiting embodiment of the invention, there is provided a building block for a ventilated wall comprising: an elongated center portion flanked by a pair of substantially parallel side walls oriented substantially perpendicularly to the center portion, the center portion having a first vertical wall and a second sloped wall, said second sloped wall extending between a relatively thicker bottom wall of the center portion and a relatively thinner top wall of the center portion; and wherein the first wall is substantially co-planar with first edges of the side walls.

In another aspect, the invention relates to a wall unit comprising at least first and second building blocks each having an elongated center portion flanked by a pair of substantially parallel side walls oriented substantially perpendicularly to the center portion, the center portion having a first vertical wall and a second sloped wall, the second sloped wall extending between a relatively thicker base of the center portion and a relatively thinner top of the center portion; the first wall being co-planar with first edges of the side walls, and wherein the first and second building blocks are stacked one on the other, with the second block inverted and reversed relative to the first block.

In still another embodiment, the invention relates to a mold assembly for forming a ventilated construction block, the mold assembly comprising a mold core including a centrally-located block portion attached to an underside of a core plate portion, the block portion having an inverted, truncated, substantially right-triangle shape including a first sloped surface.

The invention will now be described in detail in connection with the drawings identified below.

DETAILED DESCRIPTION OF THE INVENTION

Figure 1:
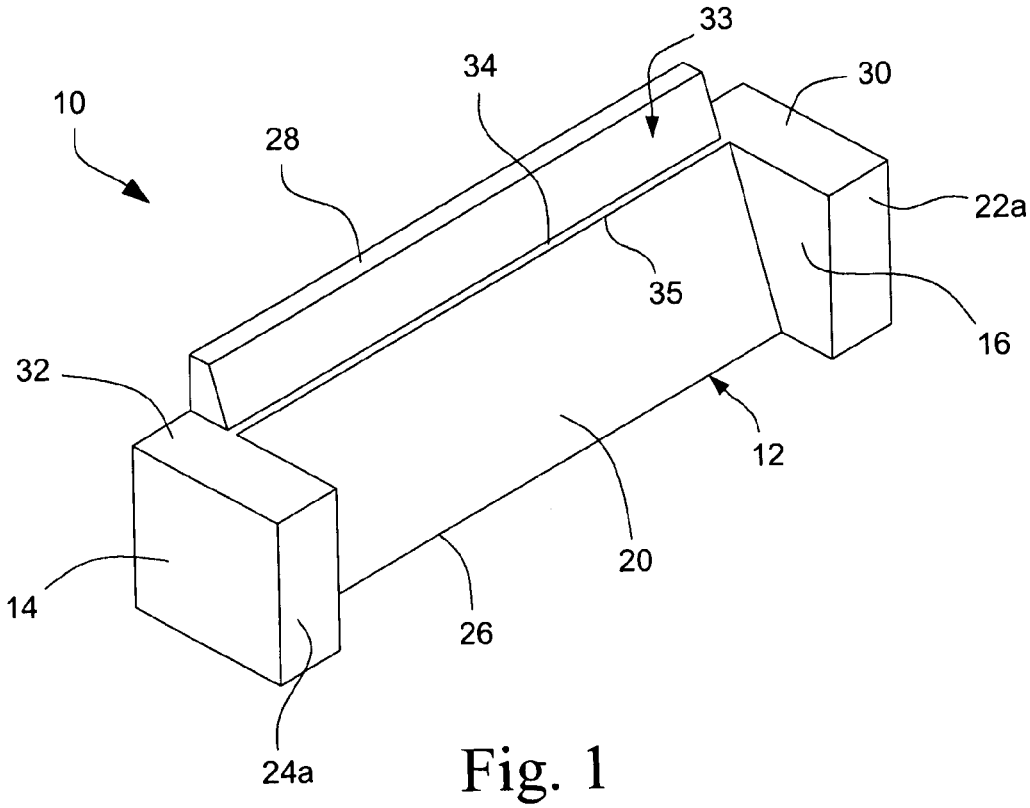
FIG. 1 is a top, left perspective view of a concrete block in accordance with an exemplary embodiment of the invention.
Figure 2:
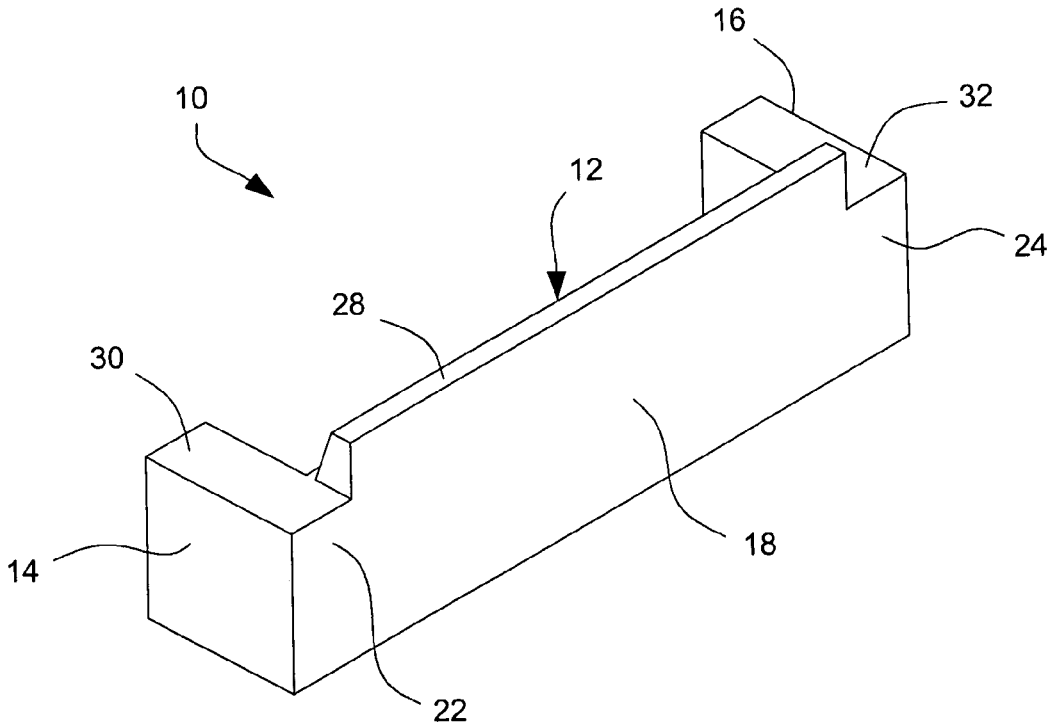
FIG. 2 is a right, rear perspective of the block shown in FIG. 1.
Figure 3:
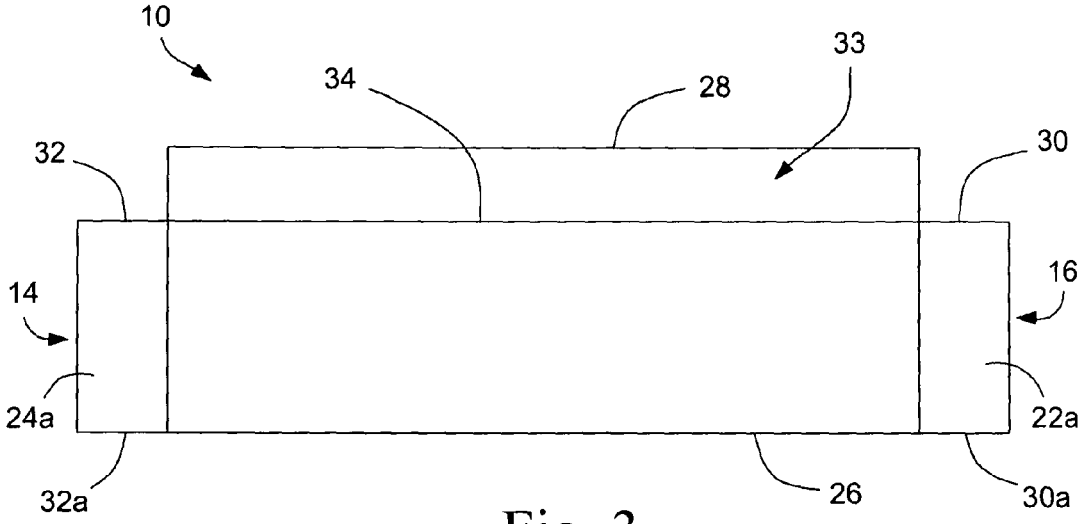
FIG. 3 is a front elevation view of the block shown in FIGS. 1 and 2.
Figure 4:
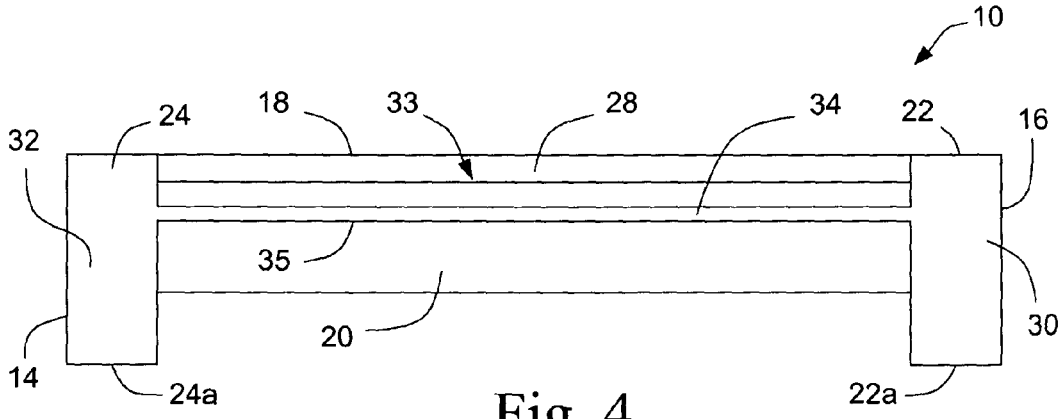
FIG. 4 is a top plan view of the block shown in FIGS. 1 and 2.
Figure 5:
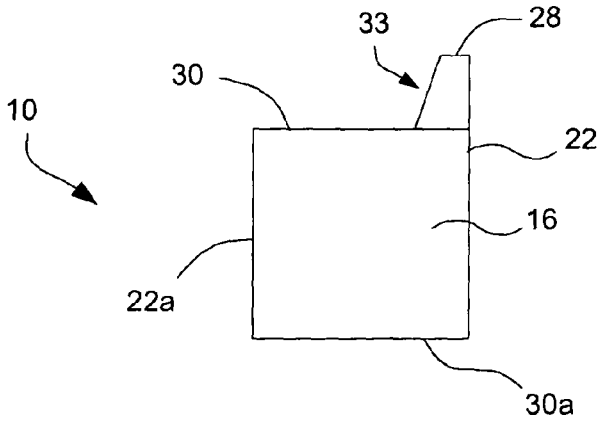
FIG. 5 is a right side elevation of the block shown in FIG. 4.
Figure 6:
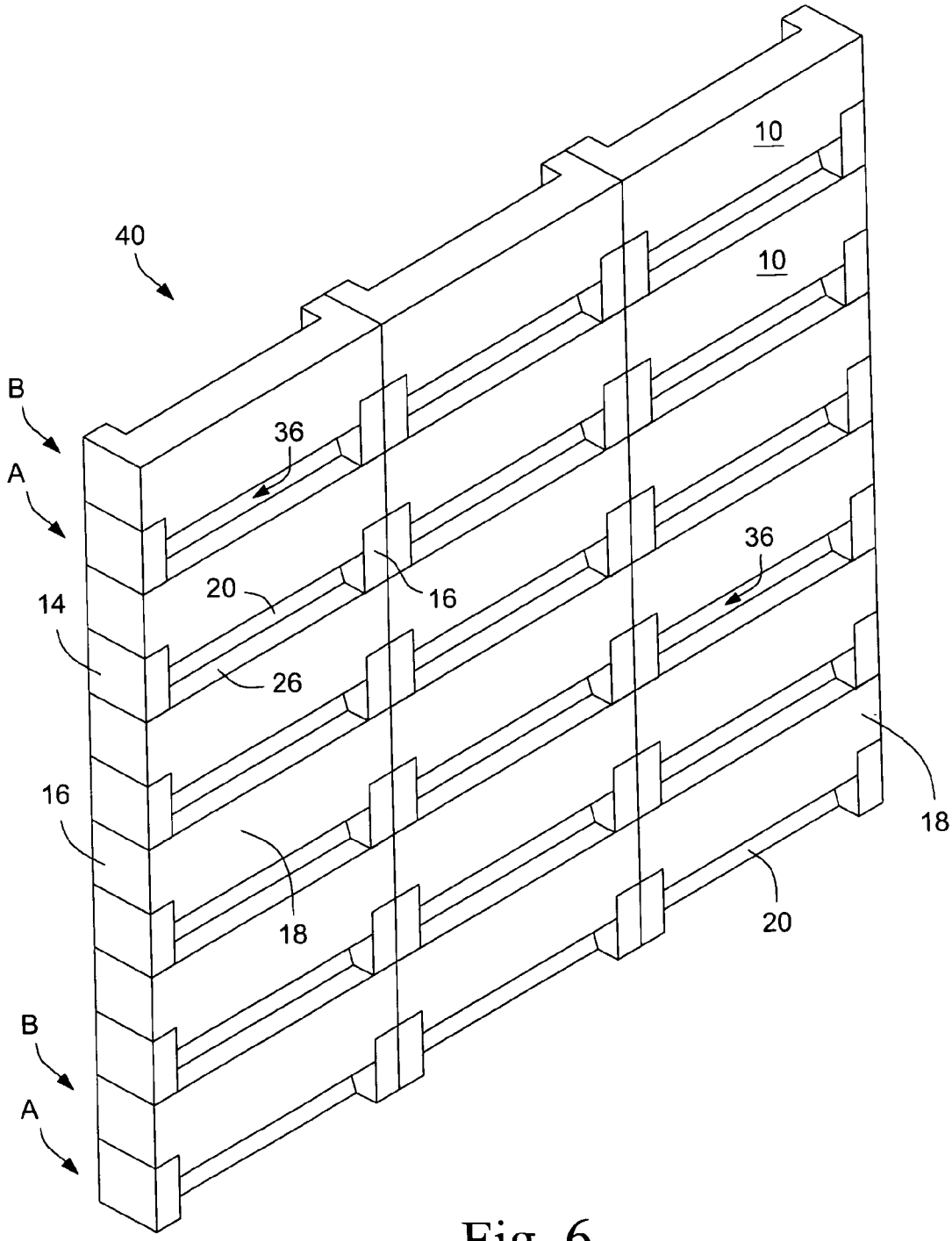
FIG. 6 is a perspective view of the exterior side of a wall constructed of blocks shown in FIGS. 1-5.

With reference initially to FIGS. 1-5, a block 10 is formed (e.g., molded) to include an elongated center portion 12 with a pair of side walls 14, 16 arranged at either end of the center portion, and substantially perpendicular thereto. For ease of understanding, the block will be described as having a front and a back, top and bottom but it will be appreciated that these terms are relative, and are not intended to be limiting in any respect. Thus, for example, in FIG. 1, the block 10 may be regarded as a top, left, front perspective view, with FIGS. 2-5 described relative to FIG. 1. Accordingly, the reference to "top", "bottom", "front", "back", "left" and "right" refers to the block in FIG. 1, with its "front" side facing forward. It will be understood, however, that adjacent upper and lower blocks are reversed and inverted on assembly, so that the characterization of the block with reference to FIG. 1 is for convenience only.

Accordingly, the center portion 12 of the block has a flat, substantially vertical back wall 18 and a sloped front wall 20. The back wall 18 is flush or co-planar with back (or first) edges 22, 24 of the side walls 14, 16, respectively. The sloped front wall 20 extends between a relatively thicker bottom wall or base 26 to a relatively thinner top wall 28, the acute slope angle preferably in the range of about 45-90° (shown at 71.3° in FIG. 5) relative to the horizontal bottom wall or base 26. The terms "thicker" and "thinner" in this context relate to the depth dimension of the block.

In this exemplary embodiment, the side walls 14, 16 extend beyond, i.e., forward of, the sloped front wall 20, and the relatively thinner top wall 28 extends above the upper (or second) edges 30, 32 of the side walls. Lower (or third) edges 30*a* and 32*a* of the sidewalls are flush with the bottom wall or base 26. A horizontal shoulder 34 extends horizontally across the sloped front wall 20 at a height substantially equal to the height of the side walls, such that shoulder 34 lies in the same horizontal plane as the upper edges 30, 32 of the side walls 14, 16. Alternatively, surface 34 could be regarded as the top surface of the block, contiguous with upper edges 30, 32, and with a truncated triangular lip 33 projecting from the surface 34, the lip inset from the front edge 35 of surface 34, but flush with the back wall 18, and extending between the inside edges of the side walls 14 and 16.

In the exemplary but non-limiting implementation of the invention illustrated in FIGS. 1-5, the block 10 may have a length (from side to side) of between about 190 mm and 460 mm (for example about 395 mm) and a depth (from front to back) of between about 80 mm and 200 mm (for example, about 92 mm). The total height of the block (from bottom to top) may be between about 80 mm and 240 mm (for example, about 124 mm). In the example shown, the lip 33 extends about 32 mm. above the side walls 30, 32 (and surface 34). The side wall thickness may be about 38.5 mm. The center portion 12 may have a depth of about 59.9 mm. at the base 26, (in this embodiment, the forward (or fourth edges) 22*a*, 24*a* of the side walls 14, 16 are forward of the center portion), and a depth of about 12 mm. at the top edge 28. The shoulder 34 may have a depth of about 6 mm. (or, stated otherwise, the lip 33 is set back from the forward edge 35 of surface 34 by about 6 mm). The dimensions of the block may vary uniformly by scale, or differentially, depending on specific applications. It will also be appreciated that the block may be constructed of any suitable building materials including in addition to concrete, such materials as metals, plastics, resins, etc.

Figure 7:
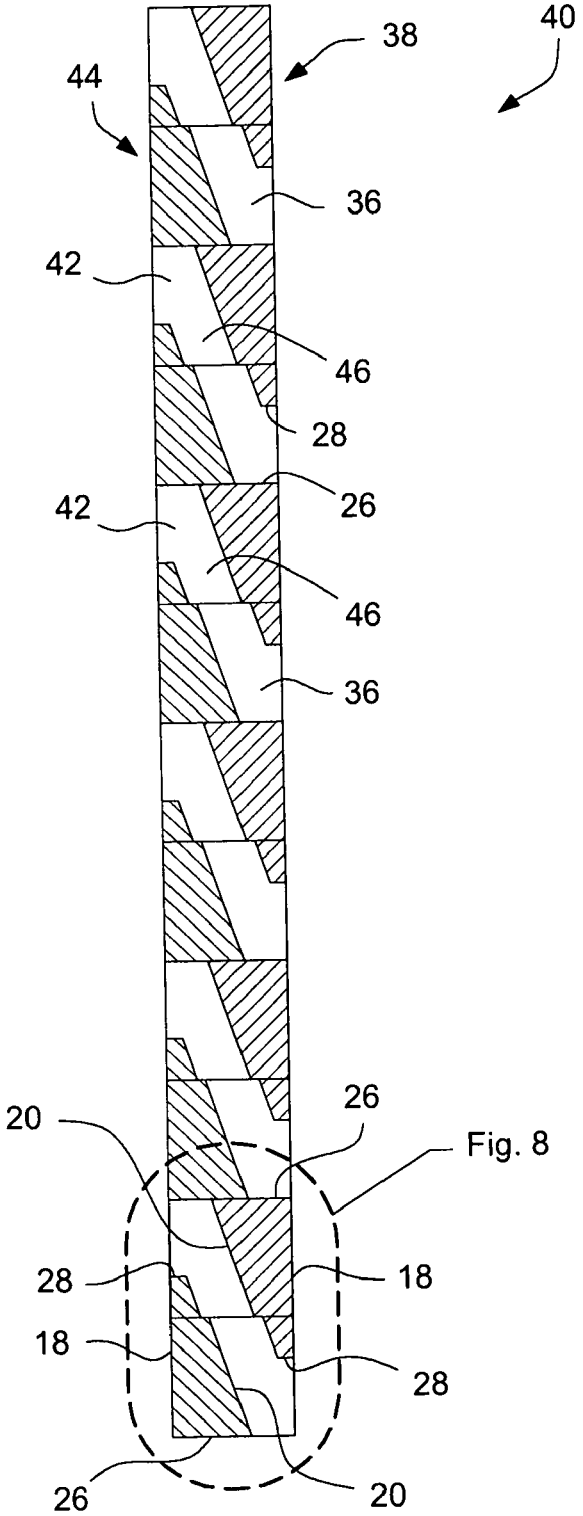
FIG. 7 is a section taken through the wall shown in FIG. 6.
Figure 8:
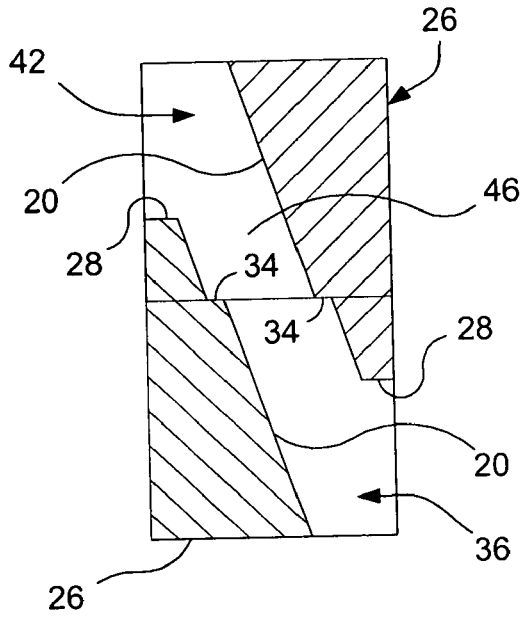
FIG. 8 is an enlarged detail taken from FIG. 7.
Figure 9:
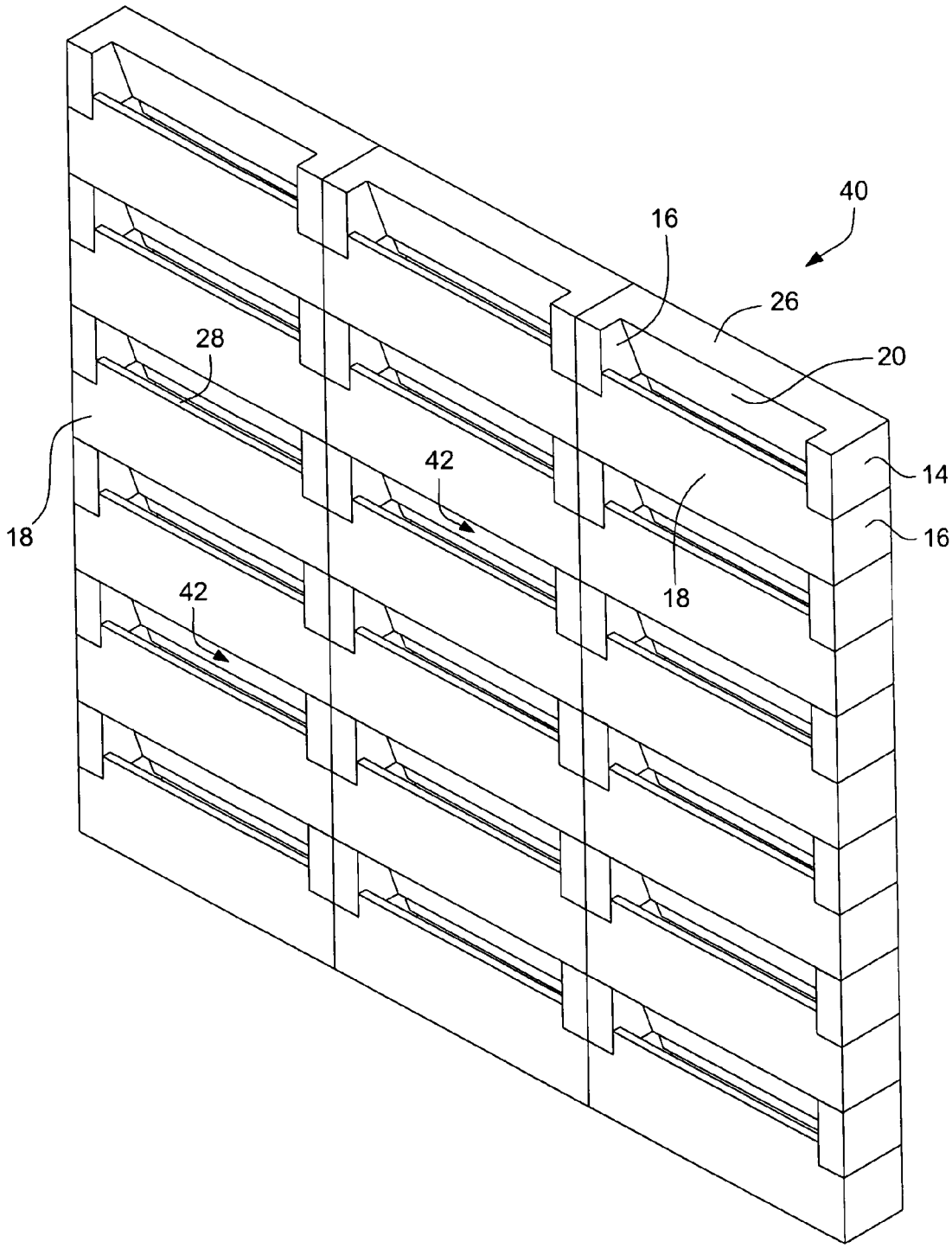
FIG. 9 is a perspective view of the interior side of the wall shown in FIG. 6.

With reference now to FIGS. 6-9, a wall unit (or simply, wall) 40 may be constructed of plural blocks 10 stacked one on top of the other, but with alternate blocks inverted and reversed, i.e., rotated 180° (front to back) as shown in FIGS. 6-9. Thus, the front, back, top and bottom edges of blocks 10 in one horizontal row A of blocks in a vertically-stacked array, become the back, front, bottom and rear edges, respectively, of the next adjacent horizontal row B of blocks. The load-bearing surfaces are the top and bottom edges 30, 32 and 30*a*, 32*a*, respectively (see FIGS. 1-5), of the engaged side walls 14, 16 of adjacent blocks. Note, as best seen in FIGS. 7 and 8 that the top edge 28 of each inverted block 10 is vertically spaced from the base 26 of the next adjacent block, leaving a forward facing slot or aperture 36 on the forward (exterior) face 38 of the wall 40, and a rearward slot or aperture 42 on the rearward (interior) face 44 of the wall, connected by an upwardly and rearwardly sloping air flow passage 46 formed by adjacent sloped walls 20 of adjacent pairs of stacked blocks. Thus the forward-facing aperture 36 is vertically spaced from the rearward-facing aperture 42, so that there is no line of sight from one side of the wall unit to the other. The upwardly sloped passage 46 also prevents rain, even horizontal rain caused by excessive wind, from passing through the wall. Thus, the wall 40 has the three-fold advantage of ventilation, privacy and rain protection. It will be appreciated that the size of any individual wall unit 40 is application-dependent, but a unit made up of only two blocks is within the scope of this invention.

Figure 10:
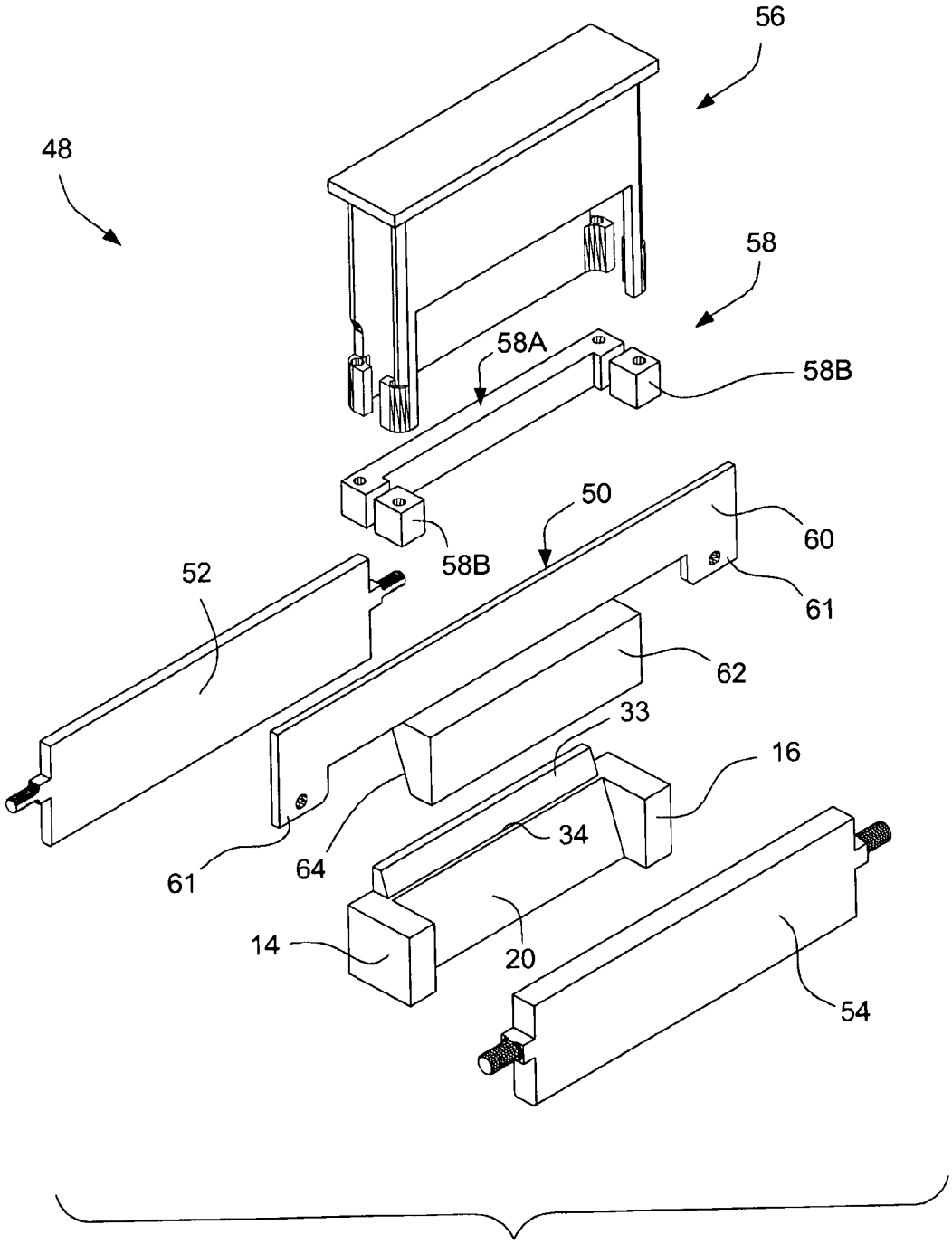
FIG. 10 is an exploded perspective view of a mold assembly used in the production of blocks as shown in FIGS. 1-5.
Figure 11:
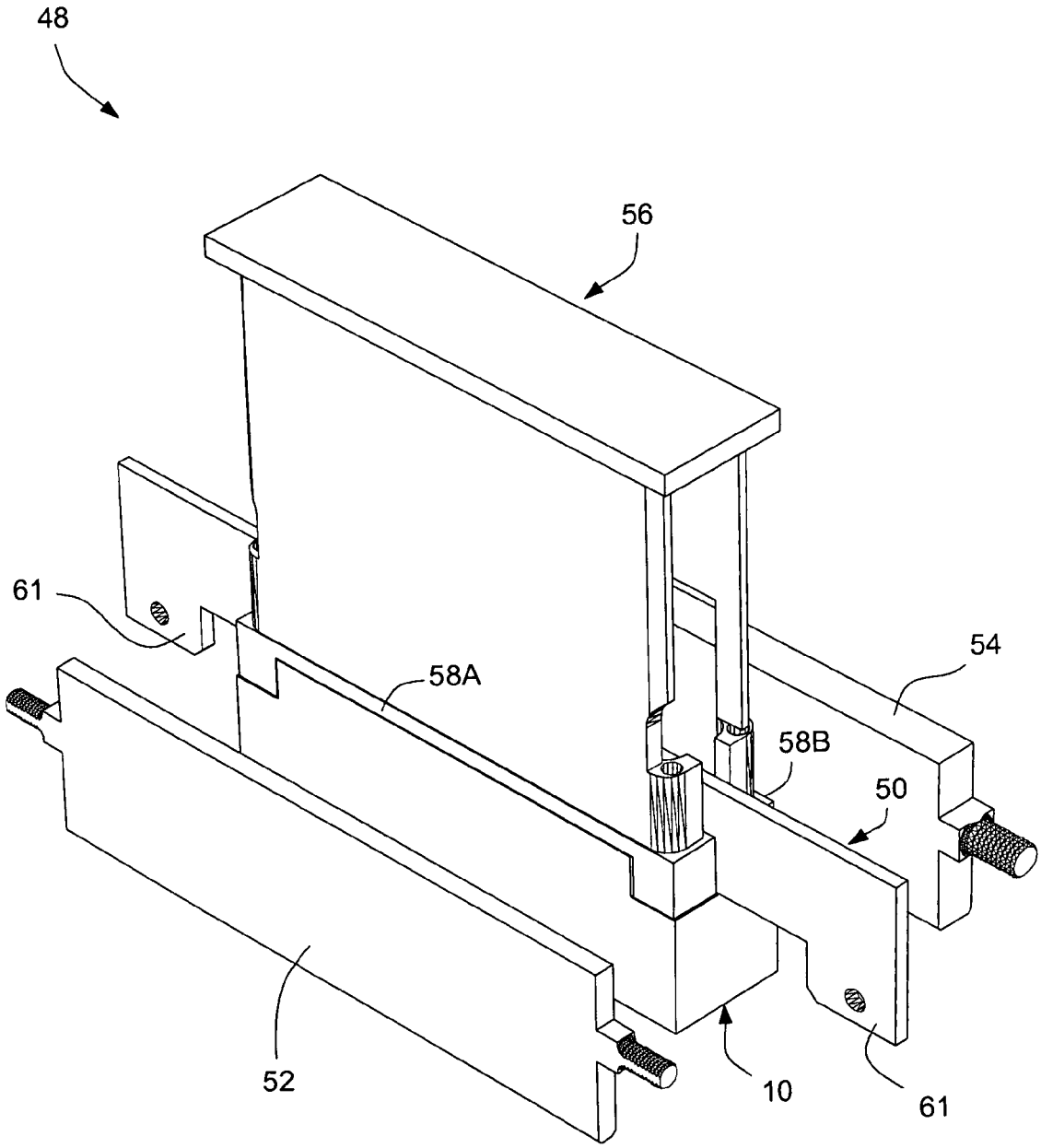
FIG. 11 is a perspective view of the mold assembly of FIG. 10 but in partially assembled form.
Figure 12:
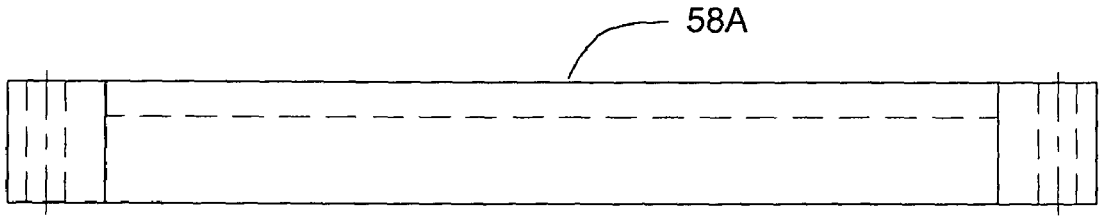
FIG. 12 is a plan view of one component of a stripper shoe subassembly taken from FIGS. 10 and 11.
Figure 13:
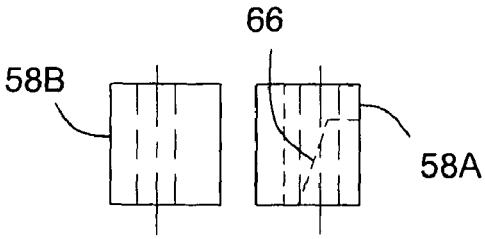
FIG. 13 is an end elevation of the stripper shoe subassembly of FIGS. 10 and 11.
Figure 14:
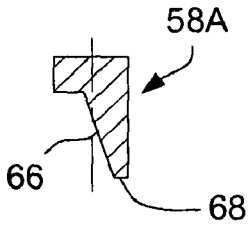
FIG. 14 is a section taken along the line 14-14 of FIG. 15.
Figure 15:
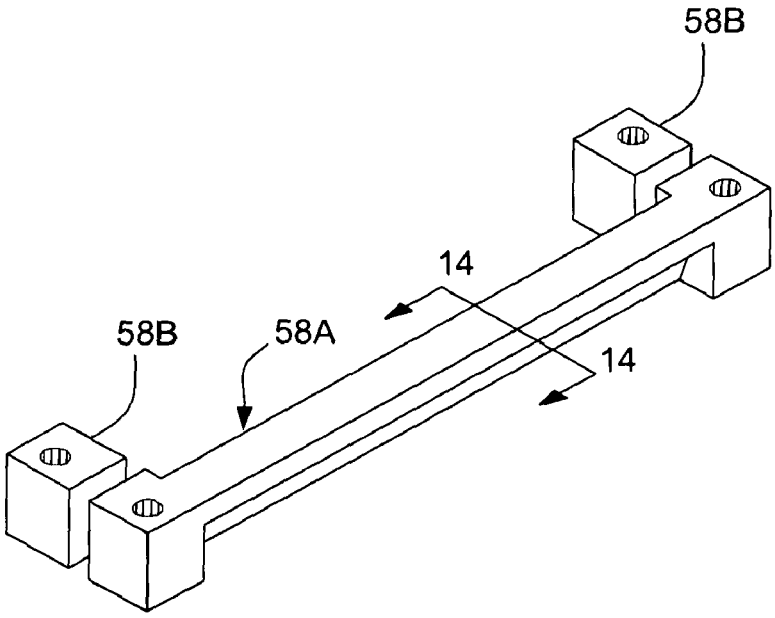
FIG. 15 is a perspective view of the stripper shoe subassembly shown in FIGS. 10, 11 and 13.
Figure 16:
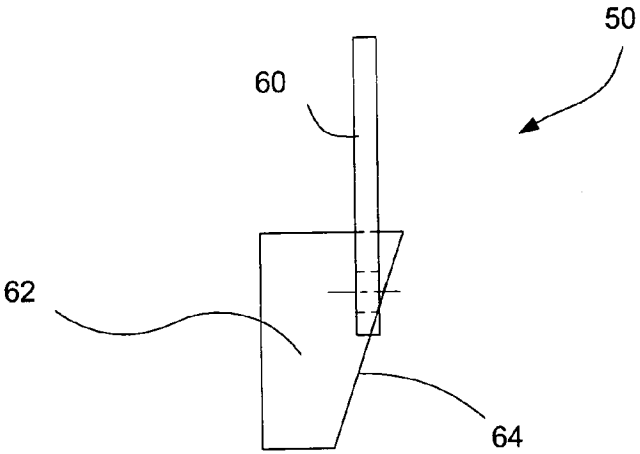
FIG. 16 is an end elevation of a mold core component taken from the mold assembly of FIGS. 10 and 11.
Figure 17:
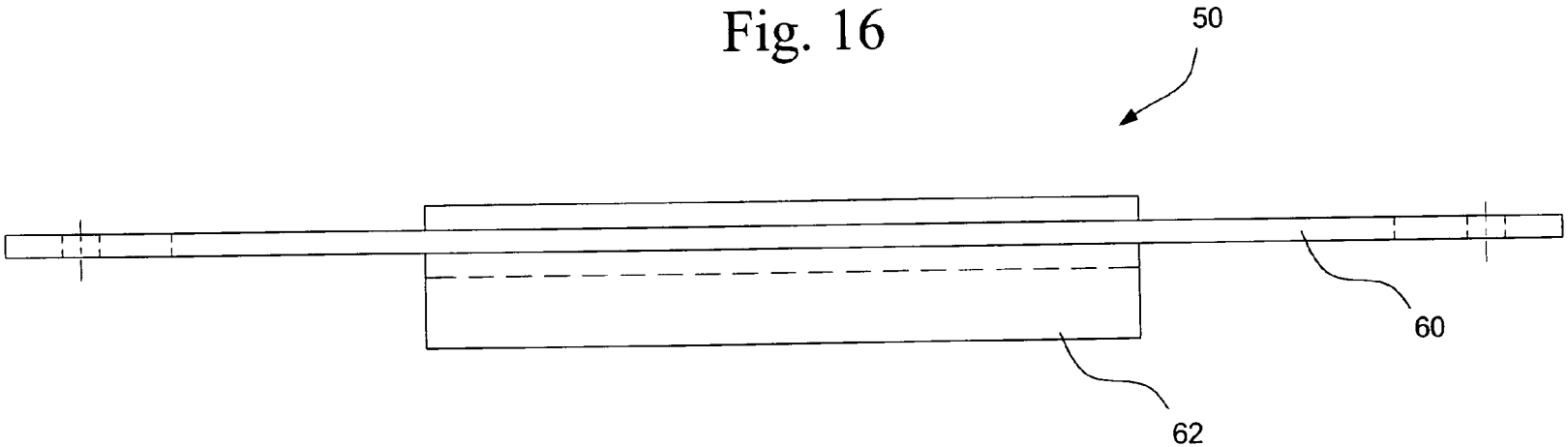
FIG. 17 is a plan view of the mold core component of FIG. 16.

Turning now to FIGS. 10 and 11, one example of a mold assembly that could be used to form the above-described block 10 is illustrated. The mold assembly or apparatus may be used in conventional block manufacturing machines available from, for example, Besser Mfg. Co. or Columbia Machine Co. A mold assembly 48 designed especially for the block 10 may include a core 50, an outside division plate 54, an inside division plate 52, and a pair of end liners (not shown) bolted together in a mold box (also not shown). The plunger 56 and stripper shoe assembly 58 are bolted together and attached to a stripper head plate (not shown) that enables the plunger 56 and stripper shoe assembly 58 to move down into the mold box. This construction is conventional except for certain components which are designed to produce the unique block shape described above. For example, the shape of the core 50 and stripper shoe assembly 58 are specially shaped to provide the sloped wall 28 and horizontal shoulder 34. The stripper shoe assembly includes the stripper bar 58A and a pair of blocks 58B. The bar 58A and blocks 58B are adapted to be bolted to the bottom of the plunger 56 in the orientation shown in FIGS. 10 and 11, with a vertical space between the bar 58A and blocks 58B for receiving a portion of the core 50 as described below. The core 50 includes a laterally extending, vertically-oriented plate portion 60, including bolting flanges 61, and a core block portion 62. Note in this regard that the sloped surface 64 on the core block portion 62 (FIG. 10) and the continuation of that surface via the interior sloped surface 66 on the stripper shoe component 58A, best seen in FIGS. 11-13, enable formation of the sloped surface 20 and the lip 33 of the block 10, extending between the side walls 14, 16. In this regard, the lower edge 68 enables formation of shoulder 34.

In the block manufacturing process, a pallet plate (not shown) is moved into position below the mold box, and concrete is poured into the box. The mold box is vibrated to settle and uniformly distribute the concrete, and then the plunger 56 and stripper shoe 58 are moved into the box to compress the concrete while under vibration, within the confines of the inner and outer divider plates 52, 54, end liners (not shown) and about the core 50. When the block 10 has been formed, it is stripped from the mold by removing the pallet, enabling the stripper shoe and plunger to push the finished product out of the mold box.

It will be appreciated that other block configurations are within the scope of this invention. For example, the sloped center portion may be flat as shown in FIGS. 1-5 or concave (when facing as shown in FIG. 1), and may extend at its base or bottom wall to a point behind the forward edges 22*a*, 24*a* of the side walls 14, 16 as shown in FIGS. 1-5, or may be substantially flush with the forward edges 22*a*, 24*a* of the side walls. In addition, the horizontal shoulder 34 may be omitted, with a simple transition between the sloped surface and the extended lip 33. In another variation, the front face of the lip and the sloped center portion could be co-planar.

In still another embodiment, a vertical center wall may be interposed between the side walls, extending parallel thereto, with a gap between the adjacent lip portions. This arrangement is especially suited for wider blocks where the center wall will provide additional strength.

For these and other block shapes within the scope of the invention, appropriate changes in the mold components are required, but such changes are well within the skill of the artisan having been apprised of the desired configuration of the block.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A building block for a ventilated wall comprising:

an elongated center portion flanked by a pair of substantially parallel side walls oriented substantially perpendicularly to said center portion, said parallel side walls having upper and lower edges, said center portion having a first vertical wall and a second sloped wall, said second sloped wall extending between a relatively thicker bottom wall of said center portion and a relatively thinner top wall of said center portion; wherein said relatively thinner top wall of said center portion projects upwardly beyond the upper edges of said side walls; and wherein said first vertical wall is substantially co-planar with rearward edges of said side walls; and further wherein said side walls extend beyond an edge of said relatively thicker bottom wall of said center portion; and said edge of said relatively thicker bottom wall is coplanar with the lower edges of said side walls.

2. The building block of claim 1 wherein said side walls are substantially square when viewed from either end of the block.

3. The building block of claim 1 wherein a horizontal shoulder extends along said second sloped wall at a height substantially equal to a height dimension of said side walls.

4. The building block of claim 1 wherein said sloped second wall has a slope angle of about 70° relative to said thicker edge of said center portion.

5. The building block of claim 1 having a length dimension of between about 190 mm and 460 mm, a depth of between about 80 mm and 200 mm, and a height of between about 80 mm and 240 mm.

6. The building block of claim 5 wherein said second sloped wall has a slope angle of between 45° and 90°.

7. A building block for a ventilated wall comprising:

an elongated center portion flanked by a pair of substantially parallel side walls oriented substantially perpendicularly to said center portion, said center portion having a first vertical wall and a second sloped wall, said second sloped wall extending between a relatively thicker bottom wall of said center portion and a relatively thinner top wall of said center portion, said bottom wall flush with bottom edges of said side walls, said first vertical wall being co-planar with first edges of said side walls and extending between said bottom wall and said top wall, said relatively thinner top wall of said center portion projecting upwardly beyond proximate top edges of said side walls that are substantially perpendicular to said first edges of said sidewalls, said side walls extending forwardly of said relatively thicker bottom wall of said center portion, and wherein said block is thus configured to be stackable directly on, and in vertical alignment with, a like underlying block that is inverted and reversed relative to said block, with sidewalls of the like underlying block engageable with said sidewalls of said block.

* * * * *